United States Patent [19]

Welzel

[11] 4,073,150

[45] Feb. 14, 1978

[54] SUSPENDED VALVE CONTROL DEVICE

[75] Inventor: Josef Welzel, Wuppertal, Germany

[73] Assignee: Hermann Hemscheidt Maschinenfabrik, Germany

[21] Appl. No.: 798,004

[22] Filed: May 18, 1977

[30] Foreign Application Priority Data

May 22, 1976 Germany ..... 2623031

[51] Int. Cl.[2] ..... E21D 15/00

[52] U.S. Cl. ..... 61/45 D; 61/63; 248/357

[58] Field of Search ..... 61/45 D, 63; 299/12, 299/30; 173/43; 254/168; 180/77 R, 77 C, 77 S, 77 MC; 214/1 MC, 1 MS; 91/170 MP, 428, 414; 248/357

[56] References Cited

U.S. PATENT DOCUMENTS

| | | | |
|---|---|---|---|
| 1,870,385 | 8/1932 | Seaman et al. | 254/168 X |
| 3,125,200 | 3/1964 | Kaman | 254/168 UX |
| 3,295,331 | 1/1967 | Blaser et al. | 61/45 D |
| 3,431,983 | 3/1969 | Jacobson | 173/43 |
| 3,514,961 | 6/1970 | Shuttleworth | 61/45 D |
| 3,564,974 | 2/1971 | Painter | 91/170 MP |
| 3,884,365 | 5/1975 | Thomson | 214/1 CM |

*Primary Examiner*—Dennis L. Taylor
*Attorney, Agent, or Firm*—Berman, Aisenberg & Platt

[57] ABSTRACT

A multiple valve control device is suspended by means of a chain or other flexible supporting means such as a cable from a rod or bar carried on a walking mine-roof support frame, the chain or other flexible supporting means being movable with and/or along the rod or bar and being adjustably hooked or otherwise releasably fastened in any one of a line of recesses in a balance beam secured to the control device.

4 Claims, 2 Drawing Figures

SUSPENDED VALVE CONTROL DEVICE

This invention relates to an assembly comprising a multiple valve control device for use with an hydraulic walking mine-roof support frame, the said device being designed to actuate working valves supplying pressurized fluid to the working cylinders of a walking mine-roof support frame.

By means of the multiple valve control device, a walking frame to be retreated can be remote-controlled from an adjacent frame, thereby protecting the operator during such retreating, particularly when geological conditions in the mine are bad. A disadvantage of existing assemblies, however, is that such control can be applied only from one side of the frame. As control from the other side of the frame may sometimes be advantageous for various reasons, an aim of the present invention is to ensure that a frame in operation can be controlled from adjacent frame on either side of the frame.

To this end, according to the invention, the multiple valve control device is suspended by means of a chain or other flexible supporting means such as a cable from a rod or bar carried on a walking mine-roof support frame, the chain or other flexible supporting means being movable with and/or along the rod or bar and being adjustably hooked or otherwise releasably fastened in any one of a line of recesses in a balance beam secured to the control device.

Advantageously, the chain or other flexible supporting means is suspended from a rod or bar which extends across the frame at an angle to the walking direction of the latter.

Because the control device is carried by a roof-support frame which is being retreated and is actuated from an adjacent frame, the above assembly retains the advantages of direct control of the retreating frame. Now, however, the retreating frame can be operated from either side, so that operation of the hydraulic props forming part of the frame is simplified. In many underground workings, the operator follows immediately behind the mining machine(s) and, consequently, when a frame has to be retreated, he approaches it alternately from below and from above. After such retreating operation, therefore, the control device is moved across from one side of the frame to the other side. Consequently, during his next transit, the operator will then be facing an end face of the control device provided with press-buttons and can immediately begin the retreating operation under the protection of the previously-advanced frame. If this were not so, he would have to start from the rearward frame on the return journey, and would not have a good view of the retreating operation. Furthermore, the previously-advanced frame gives better protection.

Figure 1:
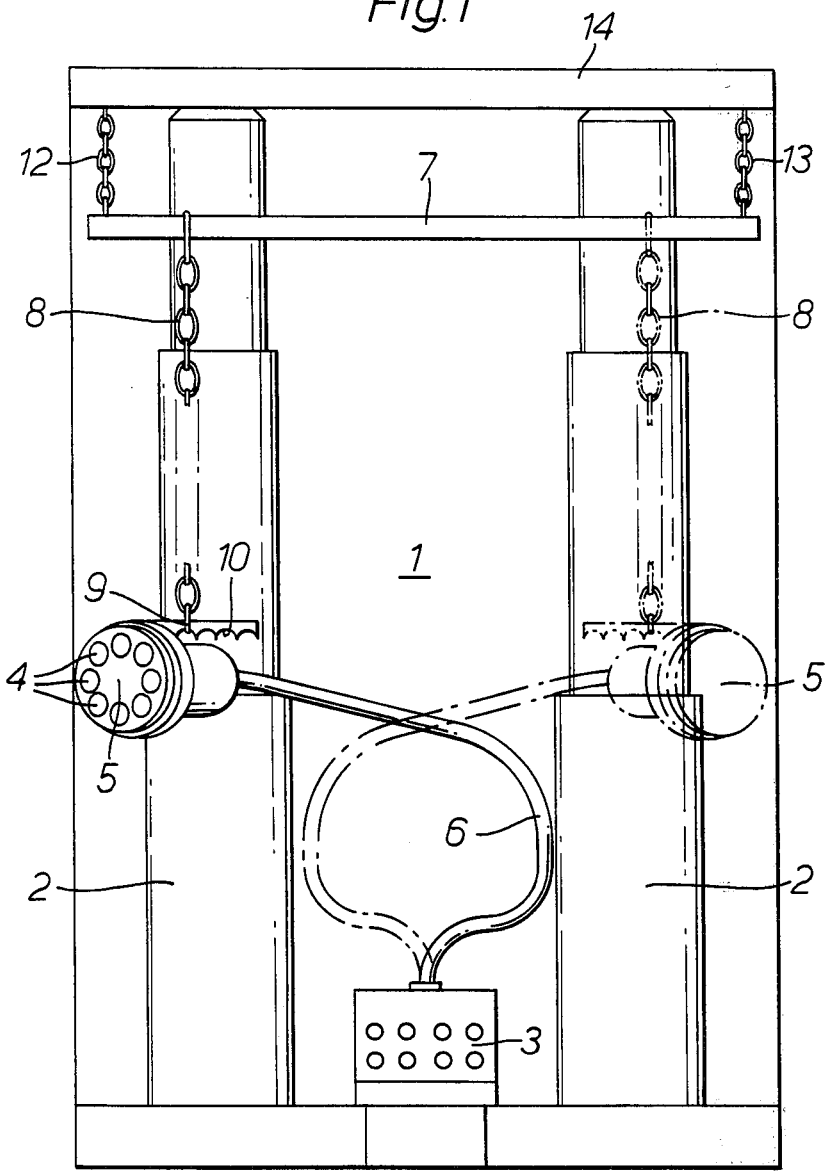
Figure 2:
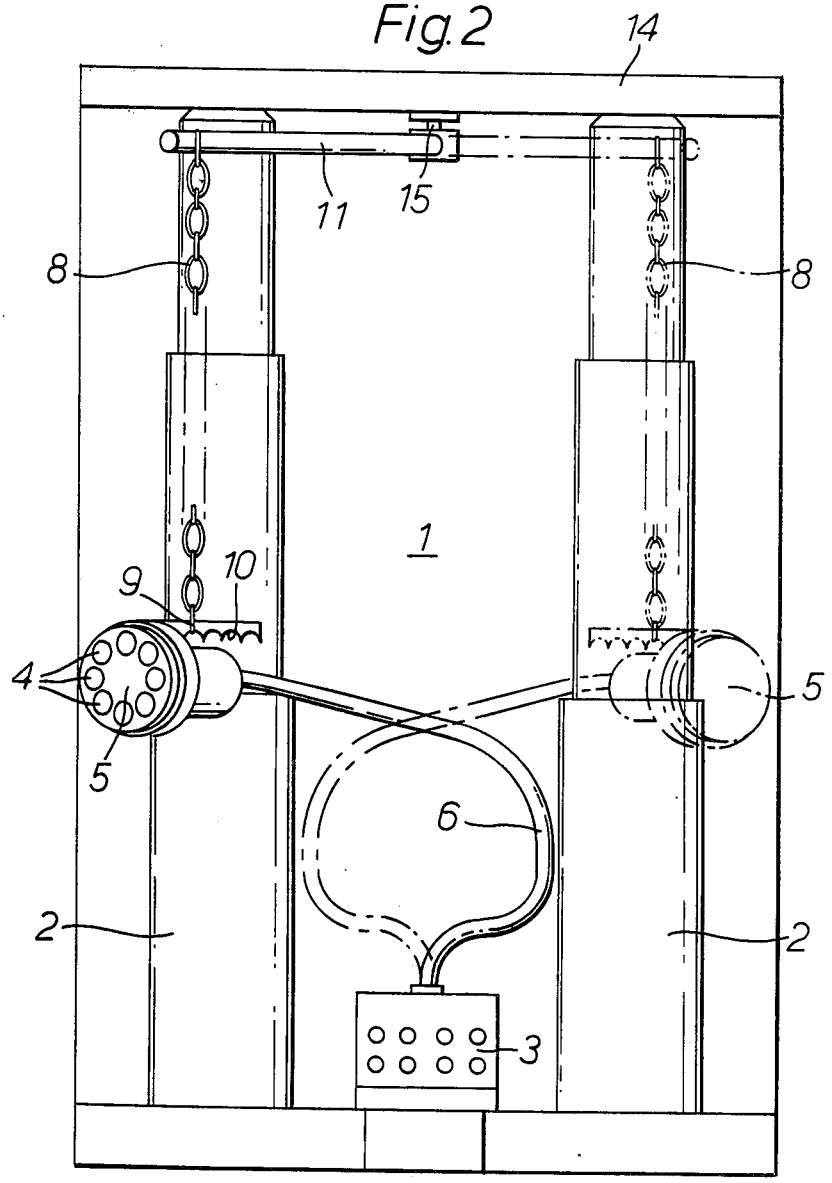

Two examples of assemblies in accordance with the invention are shown in the accompanying drawings, in which:

FIG. 1 is a front view of an hydraulic walking mine-roof support frame comprising a linearly-movable guided multiple valve control device; and FIG. 2 is a front view of an hydraulic walking mine-roof support frame comprising a pivotable guided multiple valve control device.

The walking mine-roof support frames 1 shown in FIGS. 1 and 2 are each equipped with hydraulic props 2 and other hydraulic working cylinders (not shown), which are supplied with pressurized hydraulic fluid by working valves 3. The valves 3 are operated under remote control by pressure pulses delivered along a control line 6 by an hydraulic multiple valve control device 5 comprising press-buttons 4.

In the embodiment shown in FIG. 1, a rod or bar 7 extending horizontally at an angle to the walking direction of the frame is suspended by two chains 12 and 13 at or near its ends from a mine-roof supporting beam or cap 14 of the frame. The control device 5 is suspended freely from a chain 8 on the rod or bar 7 and can be moved all the way across the frame. In order to compensate for the weight of the control device 5 and the control line 6, a balance beam 9 is secured to the device 5 and has a line or recesses 10 in its under-surface in which the chain 8 is hooked or otherwise releasably fastened in a position such that the device 5 balances the line 6. The device 5 is guided by the line 6 so that the end-face of the device 5 containing the press-buttons 4 faces the adjacent frame in both end positions of the device 5 (i.e. the positions shown in full and broken lines in FIGS. 1.)

In the embodiment shown in FIG. 2, a rod or bar 11 for supporting the control device 5 through a chain 8 is pivotally mounted at 15 on a beam or cap 14 of the frame for swinging movement in a horizontal plane through at least a semicircle all the way across the frame. The control device 5 is suspended from the free end of the rod or bar 11 so as to move with the rod or bar 11 when the latter is swung about its axis, but the chain 8 is also movable along the rod or bar.

If desired, the chain 8 in either embodiment can be replaced by some other flexible supporting means such as a cable.

I claim:

1. An assembly comprising a hydraulic walking mine-roof support frame, a multiple valve control device suspended on said frame, working fluid valves fixed on said frame, a fluid pipe-line connecting said control device to said working valves, a bar carried on the walking mine-roof support frame, a flexible supporting means on said bar for suspending the control device from said bar, a balance beam on said control device, and a line or recesses in the balance beam, said flexible supporting means being releasably fastened in any desired one of said line of recesses.

2. An assembly according to claim 1, in which the bar extends across the frame at an angle to the walking direction of the frame.

3. An assembly according to claim 2, in which the bar is suspended by two chains at its end portions from a mine-roof supporting beam of the frame.

4. An assembly according to claim 1, in which the bar is pivotally mounted on the frame for swinging movement through at least a semicircle.

* * * * *